US006895941B2

(12) United States Patent
Matthews et al.

(10) Patent No.: US 6,895,941 B2
(45) Date of Patent: May 24, 2005

(54) METHOD AND APPARATUS FOR A VARIABLE DISPLACEMENT INTERNAL COMBUSTION ENGINE

(75) Inventors: Gregory P. Matthews, West Bloomfield, MI (US); Charles H. Folkerts, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/630,623

(22) Filed: Jul. 30, 2003

(65) Prior Publication Data

US 2004/0055569 A1 Mar. 25, 2004

Related U.S. Application Data

(63) Continuation-in-part of application No. 10/104,111, filed on Mar. 22, 2002, now Pat. No. 6,782,865, and a continuation-in-part of application No. 09/847,106, filed on May 3, 2001.

(51) Int. Cl.[7] ..... F02D 17/02
(52) U.S. Cl. ..... 123/481; 123/399
(58) Field of Search ..... 123/198 F, 481, 123/399

(56) References Cited

U.S. PATENT DOCUMENTS 6,615,804 B2 * 9/2003 Matthews et al. ..... 123/481
6,619,258 B2 * 9/2003 McKay et al. ..... 123/350
6,687,602 B2 * 2/2004 Ament ..... 701/110

* cited by examiner

*Primary Examiner*—Mahmoud Gimie
*Assistant Examiner*—Hyder Ali
(74) *Attorney, Agent, or Firm*—Christopher DeVries

(57) ABSTRACT

An engine control system including a variable displacement internal combustion engine, a plurality of cylinders located in the internal combustion engine, a plurality of fuel injectors for providing fuel to the plurality of cylinders, a plurality of valves coupled to the plurality of cylinders, the plurality of valves controlling the air flow in and out of the cylinders, an actuation apparatus for actuating the plurality of valves, an intake manifold coupled to the internal combustion engine, a throttle coupled to the intake manifold, a controller electronically coupled to the fuel injectors, an accelerator pedal position sensor electronically coupled to the controller, and where the controller determines the number of the cylinders to provide with fuel and air and a desired engine output torque based on the accelerator pedal position sensor and a hysteresis value.

10 Claims, 2 Drawing Sheets

METHOD AND APPARATUS FOR A VARIABLE DISPLACEMENT INTERNAL COMBUSTION ENGINE

This application is a continuation in part of, U.S. patent application Ser. No. 10/104,111, filed on Mar. 22, 2002 now U.S. Pat. No. 6,782,865, and U.S. patent application Ser. No. 09/847,106, filed May 3, 2001.

TECHNICAL FIELD

The present invention relates to the control of internal combustion engines. More specifically, the present invention relates to methods and apparatus to provide for the control of a variable displacement internal combustion engine.

BACKGROUND OF THE INVENTION

Present regulatory conditions in the automotive market have led to an increasing demand to improve fuel economy and reduce emissions in present vehicles. These regulatory conditions must be balanced with the demands of a consumer for high performance and quick response in a vehicle. Variable displacement internal combustion engines (ICEs) provide for improved fuel economy and torque on demand by operating on the principal of cylinder deactivation.

During operating conditions that require high output torque, every cylinder of a variable displacement ICE is supplied with fuel and air (also spark, in the case of a gasoline ICE) to provide torque for the ICE. During operating conditions at low speed, low load and/or other inefficient conditions for a variable displacement ICE, cylinders may be deactivated to improve fuel economy for the variable displacement ICE and vehicle. For example, in the operation of a vehicle equipped with an eight cylinder ICE, fuel economy will be improved if the ICE is operated with only four cylinders during low torque operating conditions by reducing throttling losses. Throttling losses, also known as pumping losses, are the extra work that an ICE must perform to pump air around the restriction of a relatively closed throttle plate and pump air from the relatively low pressure of an intake manifold through the ICE and out to the atmosphere. The cylinders that are deactivated will not allow air flow through their intake and exhaust valves, reducing pumping losses by forcing the ICE to operate at a higher throttle plate angle and a higher intake manifold pressure. Since the deactivated cylinders do not allow air to flow, additional losses are avoided by operating the deactivated cylinders as "air springs" due to the compression and decompression of the air in each deactivated cylinder.

Previous variable displacement ICE's suffered from driveability issues created by their control systems. A transition in a previous variable displacement eight cylinder ICE to six or four cylinder operation created noticeable torque disturbances that affected the operation of the vehicle. These torque disturbances were generally considered undesirable by consumers. The inability to control throttle position as a function of displacement in previous variable displacement ICEs contributed to the problem of torque disturbances. The introduction of new engine control devices such as electronic throttle control (ETC), engine controllers, position sensors for pedal controls, and other electronics has enabled tighter control over more functions of an ICE.

SUMMARY OF THE INVENTION

The present invention includes methods and apparatus that allow the operation of a vehicle with a variable displacement engine to be transparent to a vehicle operator. In the preferred embodiment of the present invention, an eight-cylinder internal combustion engine (ICE) may be operated as a four-cylinder engine by deactivating four cylinders. The cylinder deactivation occurs as a function of load or torque demand by the vehicle. An engine or powertrain controller will determine if the ICE should enter four-cylinder mode by monitoring the load and torque demands of the ICE. If the ICE is in a condition where it is inefficient to operate with the full complement of eight cylinders, the controller will deactivate the mechanisms operating the valves for the selected cylinders and also shut off fuel (and possibly spark in the case of a gasoline engine) to the cylinders. The deactivated cylinders will thus function as air springs to reduce pumping losses.

The method and apparatus of the present invention uses the position of an accelerator pedal and the current engine speed to generate a commanded torque signal that reduces torque sags while the ICE is reactivating all cylinders. The commanded torque signal is fed-forward such that the command occurs shortly before the ICE actually produces that amount of torque. By using commanded torque as the primary signal or variable used to determine the displacement of the variable displacement ICE, the decision to switch displacement can be made earlier than waiting for a real time measurement of torque to determine engine displacement. The threshold values at which the commanded torque would be used to either reactivate or deactivate cylinders is a calibration variable and is a function of barometric pressure. For additional driver pleasability, if the engine vacuum ever drops below a calibratable value, the ICE would reactivate all cylinders and adjust the commanded torque threshold value.

To make the change from variable to full displacement imperceptible to the driver, the ICE must be able to maintain some torque headroom when partially displaced (as predicted by the desired torque) to allow the generation of any additional torque that may be requested during the time delay of a switching cycle. The switching cycle requires approximately one thousand engine crank degrees during a change from partial to full displacement or visa-versa. Continued switching or cycling (busyness) is undesirable in a variable displacement ICE.

The present invention reduces the busyness of operating mode switching or cycling by monitoring the requested or commanded torque from an operator via the position and rate of change of an accelerator pedal. When operating conditions that generate busyness are detected, the commanded torque is incremented by a hysteresis calibration value to decrease the potential for cycling.

DESCRIPTION OF THE PREFERRED EMBODIMENT

Figure 1:
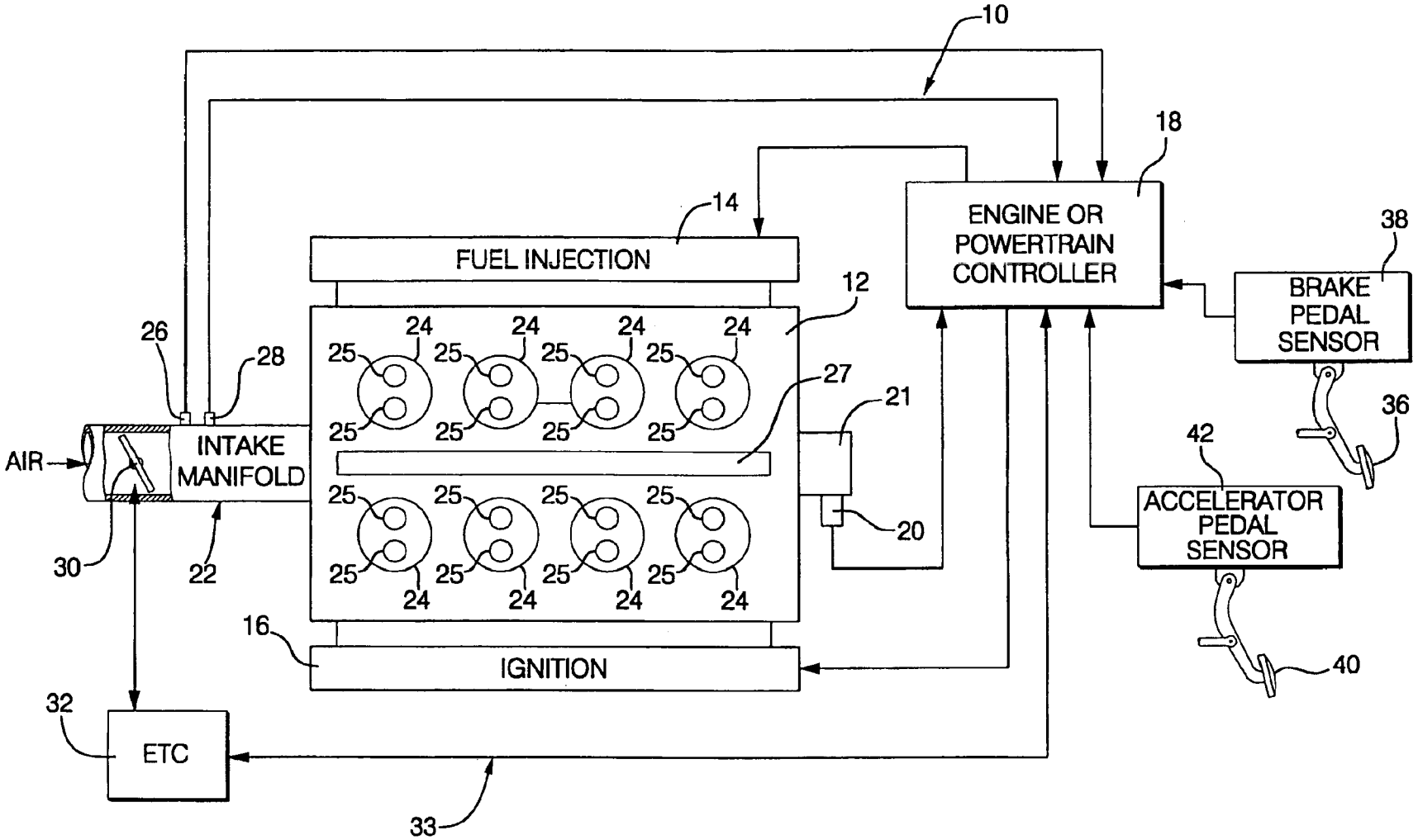
FIG. 1 is a diagrammatic drawing of the control system of the present invention.

FIG. 1 is a diagrammatic drawing of the vehicle control system 10 of the present invention. The control system 10 includes a variable displacement ICE 12 having fuel injectors 14 and spark plugs 16 controlled by an engine or powertrain controller 18. The ICE 12 may comprise a gasoline ICE or any other ICE known in the art. The ICE 12 crankshaft 21 speed and position are detected by a speed and position detector 20 that generates a signal such as a pulse train to the engine controller 18. An intake manifold 22 provides air to the cylinders 24 of the ICE 10, the cylinders 24 having valves 25. The valves 25 are further coupled to an actuation apparatus such as a camshaft 27 used in an overhead valve or overhead cam configuration that may be physically coupled and decoupled to the valves 25 to shut off air flow through the cylinders 24. An air flow sensor 26 and manifold air pressure sensor 28 detect the air flow and air pressure within the intake manifold 22 and generate signals to the powertrain controller 18. The airflow sensor 26 is preferably a hot wire anemometer, and the pressure sensor 28 is preferably a strain gauge.

An electronic throttle 30 having a throttle plate controlled by an electronic throttle controller 32 controls the amount of air entering the intake manifold 22. The electronic throttle 30 may utilize any known electric motor or actuation technology in the art including, but not limited to, DC motors, AC motors, permanent magnet brushless motors, and reluctance motors. The electronic throttle controller 32 includes power circuitry to modulate the electronic throttle 30 and circuitry to receive position and speed input from the electronic throttle 30.

In the preferred embodiment of the present invention, an absolute rotary encoder is coupled to the electronic throttle 30 to provide speed and position information to the electronic throttle controller 32. In alternate embodiments of the present invention, a potentiometer may be used to provide speed and position information for the electronic throttle 30. The electronic throttle controller 32 further includes communication circuitry such as a serial link or automotive communication network interface to communicate with the powertrain controller 18 over an automotive communication network 33. In alternate embodiments of the present invention, the electronic throttle controller 32 will be fully integrated into the powertrain controller 18 to eliminate the need for a physically separate electronic throttle controller.

A brake pedal 36 in the vehicle is equipped with a brake pedal sensor 38 to determine the frequency and amount of pressure generated by an operator of the vehicle on the brake pedal 36. The brake pedal sensor 38 generates a signal to the powertrain controller 18 for further processing. An accelerator pedal 40 in the vehicle is equipped with a pedal position sensor 42 to sense the position of the accelerator pedal 40. The pedal position sensor 42 signal is also communicated to the powertrain controller 18 for further processing. In the preferred embodiment of the present invention, the brake pedal sensor 38 is a strain gauge and the pedal position sensor 42 is an absolute rotary encoder.

The present invention controls partial displacement and full displacement operating mode cycling based primarily on commanded torque. The commanded torque variable is based on the position, rate of change of the accelerator pedal 40 and pedal position sensor 42 as well as the current engine speed. Because torque available for the ICE 12 varies with barometric pressure, engine vacuum can be used to adjust the torque switching thresholds. There is a generally an inverse linear relationship between engine vacuum pressure and available engine torque. Engine vacuum is a reactive variable where the control system must wait until the vacuum threshold is exceeded to switch. With commanded torque (derived from pedal position and pedal position rate of change) as the variable used to determine torque output, the decision to activate cylinders may be made earlier in the operation cycle, as compared to using only engine vacuum as the criteria for changing the displacement of the ICE 12. The commanded torque generated by the accelerator pedal 40 gives the controller 18 a better predictor of driver intent to allow better response from a variable displacement ICE 12.

As it takes multiple revolutions of the ICE 12 to reactivate, the use of commanded torque as the primary switching variable allows access to the full output of the variable displacement engine much faster than using engine vacuum for the switching criteria, helping to prevent possible sags in the vehicle torque while the ICE 12 is waiting to reactivate all cylinders.

Figure 2:
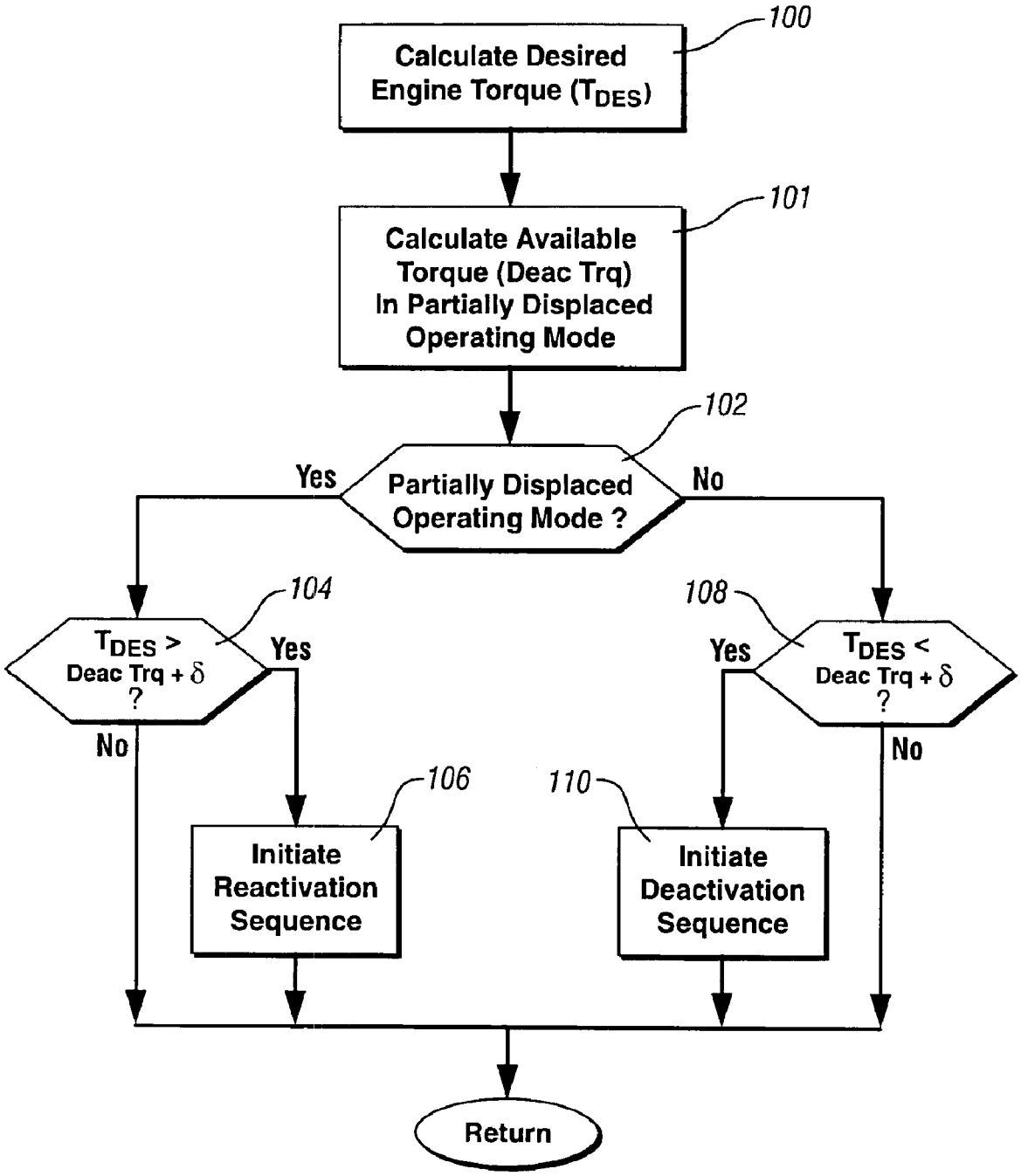
FIG. 2 is a flowchart of a preferred method for determining the operation of the control system.

FIG. 2 is a flow chart of a preferred method of the present invention. Referring to block 100 of FIG. 2, the powertrain controller 18 determines the accelerator pedal 40 position from the signal generated by the pedal position sensor 42. The powertrain controller 18 further determines the rotations per minute (RPMs) of the ICE 12 crankshaft 21 from the pulse train generated from crankshaft speed sensor 20. The powertrain controller 18 takes the acceleration pedal 40 position and other variables and determines a desired ICE 12 torque (TDES). The commanded torque generated by the accelerator pedal 40 gives the controller 18 a predictor of driver intent to allow better response from a variable displacement ICE 12.

The determination of the TDES is preferably executed using a lookup table in the powertrain controller 18 memory. TDES will be used as a load variable throughout the control system of the present invention and is the fundamental load variable of a torque-based engine control strategy. TDES can be characterized as the amount of torque that the ICE 12 in a fully displaced operating mode would produce with a given throttle position and engine speed, or it may be calculated such that given an accelerator pedal 40 position the ICE 12 produces sufficient torque for a desired vehicle performance range.

Block 101 calculates the available torque (Deac Trq) in a partially displaced operating mode for the ICE 12. Block 102 determines if the ICE 12 is in a partially displaced operating mode. If the ICE 12 is in a partially displaced operating mode, then, at block 104, the method will determine if the TDES is greater than the Deac Trq+δ. The variable δ is a hysteresis offset value that reduces the mode changes that may occur due to sensor 42 noise, a nervous foot, or a rough road. The value of variable δ may be calibrated empirically. If TDES is greater than the Deac Trq+δ, then the controller 18 will reactivate deactivated cylinders to supply the torque requested by the operator at block 106. If TDES is not greater than the Deac Trq+δ, the method will return to block 100.

Returning to block 102, if the ICE 12 is not in a partially displaced operating mode, then, at block 108, the method will determine if the TDES is less than the Deac Trq−δ. If TDES is less than the Deac Trq−δ, the controller 18 will deactivate cylinders that are not required to supply the torque requested by the operator at block 110. If TDES is greater than the Deac Trq−δ, the method will return to block 100.

While this invention has been described in terms of some specific embodiments, it will be appreciated that other forms can readily be adapted by one skilled in the art. Accordingly, the scope of this invention is to be considered limited only by the following claims.

We claim:

1. An engine control system comprising:

a variable displacement internal combustion engine;

a plurality of cylinders located in said variable displacement internal combustion engine;

a plurality of fuel injectors for providing fuel to said plurality of cylinders;

a plurality of valves coupled to said plurality of cylinders, said plurality of valves controlling the air flow in and out of said plurality of cylinders;

an actuation apparatus for actuating said plurality of valves;

an intake manifold coupled to said variable displacement internal combustion engine;

a throttle coupled to said intake manifold;

a controller electronically coupled to said fuel injectors;

an accelerator pedal position sensor electronically coupled to said controller; and wherein said controller determines the number of said cylinders to provide with fuel and air and a desired engine output torque based on a signal from said accelerator pedal position sensor and a hysteresis value.

2. The engine control system of claim 1 further comprising spark plugs for igniting said fuel provided by said fuel injectors.

3. The engine control system of claim 1 wherein said throttle is an electronic throttle.

4. The engine control system of claim 1 wherein said accelerator pedal position sensor is an encoder.

5. The engine control system of claim 1 wherein said variable displacement internal combustion engine is a gasoline engine.

6. The engine control system of claim 1 wherein said variable displacement internal combustion engine includes at least two cylinders.

7. The engine control system of claim 1 wherein said variable displacement internal combustion engine is a V8 engine.

8. The engine control system of claim 1 wherein said actuation apparatus includes a decoupling apparatus that may couple and decouple from said plurality of valves.

9. The engine control system of claim 1 further including an airflow sensor to detect airflow through said intake manifold.

10. A method of controlling the displacement of a variable displacement internal combustion engine comprising the steps of:

measuring a variable indicative of pedal position for a variable displacement internal combustion engine;

generating a torque threshold that indicates a torque condition to vary the displacement of the variable displacement internal combustion engine;

providing a hysteresis value for the pedal position to reduce busyness; and varying the displacement of the variable displacement internal combustion engine with reference to a variable indicative of pedal position and the hysteresis value.

* * * * *